US011092908B2

(12) United States Patent
Yamaura et al.

(10) Patent No.: US 11,092,908 B2
(45) Date of Patent: Aug. 17, 2021

(54) IMAGE FORMING APPARATUS HAVING A FIRST FORMING MODE FOR A FIRST MEDIUM AND A SECOND FORMING MODE FOR A SECOND MEDIUM

(71) Applicant: FUJIFILM Business Innovation Corp., Tokyo (JP)

(72) Inventors: Masaaki Yamaura, Kanagawa (JP); Yoshiyuki Tominaga, Kanagawa (JP); Kotaro Araki, Kanagawa (JP); Ayumi Noguchi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/859,415

(22) Filed: Apr. 27, 2020

(65) Prior Publication Data

US 2021/0072658 A1 Mar. 11, 2021

(30) Foreign Application Priority Data

Sep. 5, 2019 (JP) ..... JP2019-162160

(51) Int. Cl.
*G03G 15/00* (2006.01)
*G03G 15/02* (2006.01)

(52) U.S. Cl.
CPC ..... *G03G 15/0225* (2013.01); *G03G 15/5029* (2013.01); *G03G 15/6591* (2013.01); (Continued)

(58) Field of Classification Search
CPC ..... G03G 15/6591; G03G 15/5029; G03G 2215/1661; G03G 21/0094
See application file for complete search history.

(56) References Cited

U.S. PATENT DOCUMENTS 9,639,030 B2 * 5/2017 Komatsu ..... G03G 15/161
2014/0268151 A1 * 9/2014 Ohba ..... G03G 15/50 356/369

FOREIGN PATENT DOCUMENTS

JP 2006-221106 A 8/2006
JP 2006-251138 A 9/2006
JP 6340927 B2 6/2018

OTHER PUBLICATIONS

English machine-translation of Description to JP 2015-232624.*

* cited by examiner

*Primary Examiner* — Arlene Heredia
(74) *Attorney, Agent, or Firm* — Sughrue Mion, PLLC

(57) ABSTRACT

An image forming apparatus includes an image holding unit that holds an image that is formed of a developer, the image being intended to be transferred onto a medium, and an image that is not intended to be transferred onto a medium, a transfer unit that transfers the image that is intended to be transferred onto a medium onto a medium, a removing unit that removes the image that is not intended to be transferred onto a medium from the image holding unit, and a forming unit that forms the image that is not intended to be transferred onto a medium onto the image holding unit by using a developer and that has a first forming mode for a first medium and a second forming mode for a second medium that has a transfer sensitivity lower than a transfer sensitivity of the first medium, the forming unit being configured to use a larger amount of the developer in formation of the image that is not intended to be transferred onto a medium in the first forming mode than in the second forming mode.

20 Claims, 10 Drawing Sheets

(52) U.S. Cl.
CPC ..... *G03G 2215/1661* (2013.01); *G03G 2221/1627* (2013.01)

FIG. 10

| | | BAND AMOUNT 0% K／Blue | BAND AMOUNT 0.5% K／Blue | BAND AMOUNT 0.75% K／Blue |
|---|---|---|---|---|
| J PAPER (NORMAL PAPER (PPC)) | IMAGE PORTION | ○／○ | ○／○ | ○／○ |
| | NON-IMAGE PORTION | ○／○ | ○／○ | ○／○ |
| OSC PAPER (COATED PAPER) | IMAGE PORTION | ○／○ | ○／○ | ○／○ |
| | NON-IMAGE PORTION | ○／○ | ○／○ | ○／○ |
| RENDEZVOUS (ROUGH PAPER) | IMAGE PORTION | ○／○ | ○／○ | ○／○ |
| | NON-IMAGE PORTION | △／△ | ○／○ | ○／○ |
| LEATHAC (EMBOSSED) | IMAGE PORTION | ○／○ | ○／○ | ○／○ |
| | NON-IMAGE PORTION | ×／× | △／△ | ○／○ |
| BOSS YUKI (EMBOSSED) | IMAGE PORTION | ○／○ | ○／○ | ○／○ |
| | NON-IMAGE PORTION | ×／× | △／△ | ○／○ |

○ : GOOD
△ : SLIGHT ROUGHNESS
× : ROUGHNESS

IMAGE FORMING APPARATUS HAVING A FIRST FORMING MODE FOR A FIRST MEDIUM AND A SECOND FORMING MODE FOR A SECOND MEDIUM

CROSS-REFERENCE TO RELATED APPLICATIONS

This application is based on and claims priority under 35 USC 119 from Japanese Patent Application No. 2019-162160 filed Sep. 5, 2019.

BACKGROUND

(i) Technical Field

The present disclosure relates to an image forming apparatus.

(ii) Related Art

The technologies described in the following Patent Documents are known examples of a technology for forming an image that is not intended to be transferred onto a medium, the technology being employed in image forming apparatuses such as copying machines, printers, or facsimile machines.

Japanese Patent No. 6340927 (the Claims, [0038]-[0053], FIG. 6) describes a technology for forming a toner image that has a belt-like shape in a non-image region between toner images in order to forcibly use a toner that has deteriorated as a result of being stirred in a developing device without being used. In the technology described in Japanese Patent No. 6340927, when the width of a recording medium is smaller than a maximum width dimension, a large amount of a deteriorated toner is used by increasing the image density of a toner image having a belt-like shape or by increasing the length of an image.

Japanese Unexamined Patent Application Publication No. 2006-251138 ([0043]-[0050], FIG. 4) describes a technology for adjusting the density of a toner band when the toner band is formed in a region excluding an image forming region by reducing the density of the toner band when a printed image is dark and increasing the density of the toner band when the printed image is light such that a fixed amount of a toner is supplied to a cleaning device.

Japanese Unexamined Patent Application Publication No. 2006-221106 (the Claims, [0023]-[0032], FIG. 2) describes a technology for forming a toner band on a photoconductor drum on which image formation is not performed in a monochromatic-image forming mode and maximizing the toner amount of a toner band formed on the most upstream photoconductor drum in order to maintain the lubricity of a cleaning blade.

SUMMARY

Aspects of non-limiting embodiments of the present disclosure relate to ensuring the transferability of a developer with respect to a medium that has a low transfer sensitivity and reducing the amount of the developer that is used compared with the case where an image for removing discharge products is formed both when a medium having a low transfer sensitivity is used and when a medium having a high transfer sensitivity is used.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including an image holding unit that holds an image that is formed of a developer, the image being intended to be transferred onto a medium, and an image that is not intended to be transferred onto a medium, a transfer unit that transfers the image that is intended to be transferred onto a medium onto a medium, a removing unit that removes the image that is not intended to be transferred onto a medium from the image holding unit, and a forming unit that forms the image that is not intended to be transferred onto a medium onto the image holding unit by using a developer and that has a first forming mode for a first medium and a second forming mode for a second medium that has a transfer sensitivity lower than a transfer sensitivity of the first medium, the forming unit being configured to use a larger amount of the developer in formation of the image that is not intended to be transferred onto a medium in the first forming mode than in the second forming mode.

BRIEF DESCRIPTION OF THE DRAWINGS

Exemplary embodiments of the present disclosure will be described in detail based on the following figures, wherein:

FIG. 10 is a table illustrating emboss grades in an image portion and a non-image portion when the type of a sheet and the density of a toner band are changed.

DETAILED DESCRIPTION

Figure 1:
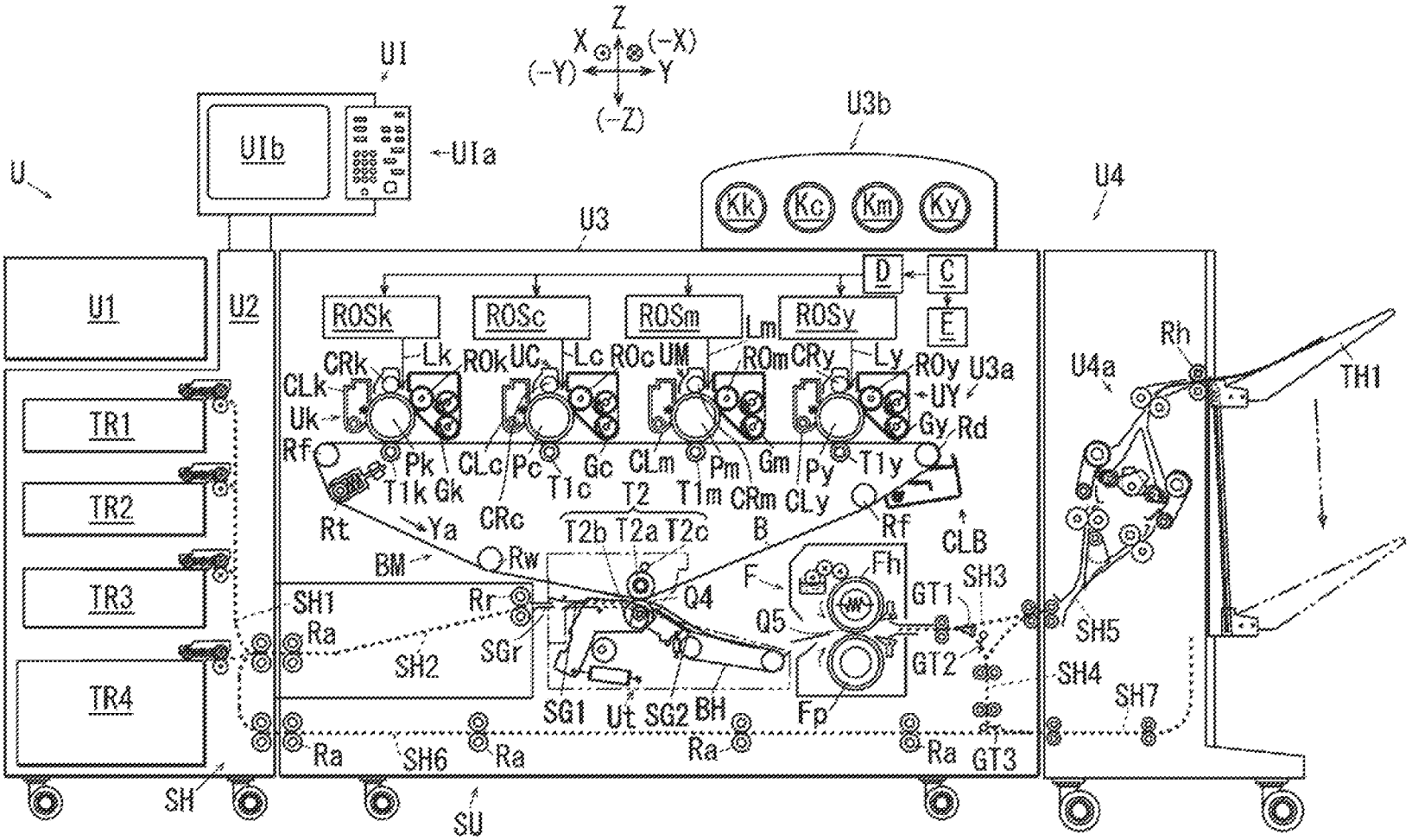
FIG. 1 is an overall view illustrating an image forming apparatus according to a first exemplary embodiment.

Although exemplary embodiments of the present disclosure will be described below as specific examples with reference to the drawings, the present disclosure is not limited to the following exemplary embodiments.

For ease of understanding of the following description, in the drawings, a front-rear direction, a left-right direction, and a top-bottom direction are respectively defined as the X-axis direction, the Y-axis direction, and the Z-axis direction, and directions or sides indicated by arrows X, −X, Y, −Y, Z, and −Z are respectively defined as a forward direction, a backward direction, a right direction, a left direction, an upward direction, and a downward direction or a front side, a rear side, a right side, a left side, a top side, and a bottom side.

An arrow extending from the rear side to the front side in the drawings is denoted by an encircled dot, and an arrow extending from the front side to the rear side in the drawings is denoted by an encircled cross.

In the following description, which refers to the drawings, descriptions of components that are not necessarily illustrated are suitably omitted for ease of understanding.

First Exemplary Embodiment

FIG. 1 is an overall view illustrating an image forming apparatus according to a first exemplary embodiment.

Figure 2:
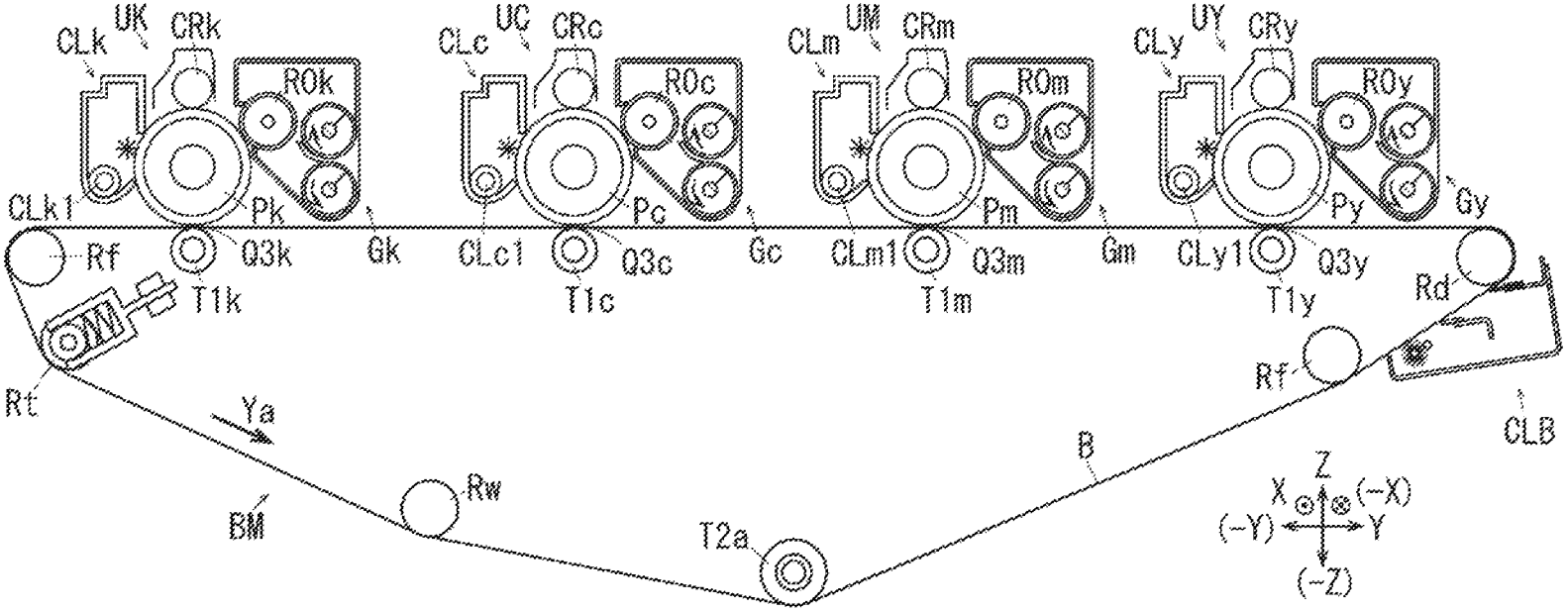
FIG. 2 is an enlarged view illustrating a visible-image forming device according to the first exemplary embodiment.

FIG. 2 is an enlarged view illustrating a visible-image forming device according to the first exemplary embodiment.

In FIG. 1, a copying machine U, which is an example of an image forming apparatus, includes a user interface UI, which is an example of an operation unit, a scanner unit U1, which is an example of an image reading device, a feeder unit U2, which is an example of a media-supply device, an image forming unit U3, which is an example of an image recording device, and a media processing device U4.

(Description of User Interface UI)

The user interface UI includes input buttons UIa that are used for, for example, starting a copying operation or setting the number of sheets to be copied. The user interface UI further includes a display UIb that displays contents that are input through the input buttons UIa and the state of the copying machine U.

(Description of Feeder Unit U2)

In FIG. 1, the feeder unit U2 includes a plurality of sheet-feeding trays TR1, TR2, TR3, and TR4, each of which is an example of a media container. The feeder unit U2 further includes a media supply path SH1, and recording sheets S, each of which is an example of an image recording medium and each of which is accommodated in one of the sheet-feeding trays TR1 to TR4, are taken out and transported along the media supply path SH1 to the image forming unit U3.

(Description of Image Forming Unit U3 and Media Processing Device U4)

In FIG. 1, the image forming unit U3 includes an image recording unit U3*a* that performs, on the basis of a document image read by the scanner unit U1, an image recording operation on one of the recording sheets S that is transported from the feeder unit U2.

In FIG. 1 and FIG. 2, a driving circuit D for latent-image forming devices ROSy, ROSm, ROSc, and ROSk outputs, on the basis of image information that is input from the scanner unit U1, driving signals corresponding to the image information to the latent-image forming devices ROSy to ROSk at a predetermined timing. The latent-image forming devices ROSy, ROSm, ROSc, and ROSk are included in the image forming unit U3 and correspond to colors of yellow (Y), magenta (M), cyan (C), and black (K), respectively. Photoconductor drums Py, Pm, Pc, and Pk, each of which is an example of an image carrier, are arranged below the latent-image forming devices ROSy to ROSk.

The surfaces of the photoconductor drums Py, Pm, Pc, and Pk that rotate are uniformly charged by charging rollers CRy, CRm, CRc, and CRk, each of which is an example of a charger. Electrostatic latent images are formed onto the charged surfaces of the photoconductor drums Py to Pk by laser beams Ly, Lm, Lc, and Lk, which are examples of latent-image writing light beams output by the latent-image forming devices ROSy, ROSm, ROSc, and ROSk. Electrostatic latent images formed on the surfaces of the photoconductor drums Py, Pm, Pc, and Pk are developed into toner images, which are examples of visible images of the colors Y, M, C, and K, by developing devices Gy, Gm, Gc, and Gk.

Note that the developing devices Gy to Gk are replenished with developers from toner cartridges Ky, Km, Kc, and Kk, each of which is an example of a developer container, after the developers have been used in a developing operation. The toner cartridges Ky, Km, Kc, and Kk are detachably mounted on a developer replenishing device U3*b*.

Toner images formed on the surfaces of the photoconductor drums Py, Pm, Pc, and Pk are sequentially transferred onto an intermediate transfer belt B, which is an example of an intermediate transfer body, in first transfer regions Q3*y*, Q3*m*, Q3*c*, and Q3*k* in such a manner as to be superposed with one another by first transfer rollers T1*y*, T1*m*, T1*c*, and T1*k*, each of which is an example of a first transfer unit, so that a color toner image, which is an example of a polychromatic visible image, is formed on the intermediate transfer belt B. The color toner image formed on the intermediate transfer belt B is transported to a second transfer region Q4.

Note that, in the case where there is only information regarding an image of color K, only the photoconductor drum Pk and the developing device Gk that correspond to color K are used, and only a toner image of color K is formed.

After completion of a first transfer process, residues such as residual developer and paper dust deposited on the surfaces of the photoconductor drums Py, Pm, Pc, and Pk are removed by drum cleaners CLy, CLm, CLc, and CLk, each of which is an example of an image-carrier cleaning unit.

In the first exemplary embodiment, the photoconductor drum Pk, the charging roller CRk, and the drum cleaner CLk are integrated with one another so as to form a photoconductor unit UK that corresponds to color K and that is an example of an image carrier unit. Similarly, a photoconductor unit UY corresponding to color Y includes the photoconductor drum Py, the charging roller CRy, and the drum cleaner CLy. A photoconductor unit UM corresponding to color M includes the photoconductor drum Pm, the charging roller CRm, and the drum cleaner CLm. A photoconductor unit UC corresponding to color C includes the photoconductor drum Pc, the charging roller CRc, and the drum cleaner CLc.

In addition, the photoconductor unit UK corresponding to color K and the developing device Gk that includes a developing roller R0*k*, which is an example of a developer holding unit, form a visible-image forming device UK+Gk that corresponds to color K. Similarly, the photoconductor unit UY corresponding to color Y and the developing device Gy that includes a developing roller R0*y* form a visible-image forming device UY+Gy that corresponds to color Y. The photoconductor unit UM corresponding to color M and the developing device Gm that includes a developing roller R0*m* form a visible-image forming device UM+Gm that corresponds to color M. The photoconductor unit UC corresponding to color C and the developing device Gc that includes a developing roller R0*c* form a visible-image forming device UC+Gc that corresponds to color C.

A belt module BM, which is an example of an intermediate transfer device, is disposed below the photoconductor drums Py to Pk. The belt module BM includes the intermediate transfer belt B, which is an example of an image holding unit, a driving roller Rd, which is an example of a driving member for an intermediate transfer body, a tension roller Rt, which is an example of a tension-applying member, a working roller Rw, which is an example of a member that prevents the intermediate transfer belt B from moving in a serpentine manner, a plurality of idle rollers Rf, each of which is an example of a driven member, a backup roller T2*a*, which is an example of an opposing member, and the above-mentioned first transfer rollers T1*y*, T1*m*, T1*c*, and T1*k*. The intermediate transfer belt B is supported in such a manner as to be move circularly in the direction of arrow Ya.

A second transfer unit Ut is disposed below the above-mentioned backup roller T2*a*. The above-mentioned second transfer unit Ut includes a second transfer roller T2*b*, which is an example of a second transfer member. The second transfer region Q4 is formed of a region in which the second transfer roller T2*b* is in contact with the intermediate transfer belt B. The backup roller T2*a*, which is an example of an opposing member, faces the second transfer roller T2*b* with the intermediate transfer belt B interposed therebetween. A contact roller T2*c*, which is an example of a power supplying member, is in contact with the backup roller T2*a*. A second transfer voltage having a polarity that is the same as the charge polarity of each of the toners is applied to the contact roller T2*c*.

The backup roller T2*a*, the second transfer roller T2*b*, and the contact roller T2*c* form a second transfer unit T2, which is an example of a transfer unit.

A media transport path SH2 is disposed below the belt module BM. One of the recording sheets S that has been fed along the media supply path SH1 of the feeder unit U2 is transported to registration rollers Rr, each of which is an example of a member that adjusts the timing of transportation, by transport rollers Ra, each of which is an example of a media transport member. The registration rollers Rr transport the recording sheet S toward the downstream side in accordance with the timing at which a toner image that has been formed on the intermediate transfer belt B is transported to the second transfer region Q4. The recording sheet S, which has been sent out by the registration rollers Rr, is guided by a sheet guide SGr, which is disposed on the side on which the registration rollers Rr are disposed, and a pre-transfer sheet guide SG1 and is transported to the second transfer region Q4.

The toner image on the intermediate transfer belt B is transferred onto the recording sheet S by the second transfer unit T2 when the toner image passes through the second transfer region Q4. Note that, in the case of a color toner image, toner images that have been transferred in the first transfer process to a surface of the intermediate transfer belt B in such a manner as to be superposed with one another are collectively transferred in a second transfer process onto the recording sheet S.

The first transfer rollers T1*y* to T1*k*, the second transfer unit T2, and the intermediate transfer belt B form a transfer device T1*y*-to-T1*k*+T2+B according to the first exemplary embodiment.

After completion of the second transfer process, the intermediate transfer belt B is cleaned by a belt cleaner CLB that is an example of a cleaning unit for an intermediate transfer body and that is disposed downstream from the second transfer region Q4. In the second transfer region Q4, the belt cleaner CLB, which is an example of a removing unit, removes residues such as residual developer that remains on the intermediate transfer belt B without being transferred and paper dust from the intermediate transfer belt B.

One of the recording sheets S to which a toner image has been transferred is guided by a post-transfer sheet guide SG2 and sent to a media transport belt BH, which is an example of a transport member. The media transport belt BH transports the recording sheet S to a fixing device F.

The fixing device F includes a heating roller Fh, which is an example of a heating member, and a pressure roller Fp, which is an example of a pressure member. The recording sheet S is transported to a fixing region Q5, which is a region in which the heating roller Fh and the pressure roller Fp are brought into contact with each other. When the recording sheet S passes through the fixing region Q5, the fixing device F applies heat and pressure to the toner image on the recording sheet S, and as a result, the toner image is fixed onto the recording sheet S.

The visible-image forming devices UY+Gy to UK+Gk, the transfer device T1*y*-to-T1*k*+T2+B, and the fixing device F form the image recording unit U3*a*, which is an example of an image forming unit according to the first exemplary embodiment.

A switching gate GT1, which is an example of a switching member, is disposed downstream from the fixing device F. The switching gate GT1 selectively switches between an ejection path SH3, which extends toward the media processing device U4, and a reverse path SH4 in such a manner that one of the recording sheets S that has passed through the fixing region Q5 is transported to the ejection path SH3 or the reverse path SH4. The recording sheet S that has been transported to the ejection path SH3 is transported to a sheet transport path SH5 of the media-processing device U4. A curl correction member U4*a*, which is an example of a curvature correction member, is disposed on the sheet transport path SH5. The curl correction member U4*a* corrects the curvature, or specifically, the curl of the recording sheet S that has been transported thereto. The recording sheet S whose curl has been corrected is ejected to an ejection tray TH1, which is an example of a media ejection unit, by ejection rollers Rh, each of which is an example of a media ejection member, in such a manner that a surface of the recording sheet S to which an image has been fixed (hereinafter referred to as an image fixed surface) faces upward.

The recording sheet S that has been transported by the switching gate GT1 to the side on which the reverse path SH4 of the image forming unit U3 is disposed passes through a second gate GT2, which is an example of a switching member, and is transported to the reverse path SH4 of the image forming unit U3.

In this case, when the recording sheet S is ejected in such a manner that the image fixed surface of the recording sheet S faces downward, after the trailing end of the recording sheet S in the transport direction has passed through the second gate GT2, the transport direction of the recording sheet S is reversed. Here, the second gate GT2 according to the first exemplary embodiment is formed of a thin-film-shaped elastic member. Accordingly, the second gate GT2 allows the recording sheet S, which has been transported to the reverse path SH4, to pass therethrough once. When the recording sheet S that has passed through the second gate GT2 is flipped over, or specifically, is switched back, the second gate GT2 guides the recording sheet S to the side on which the transport paths SH3 and SH5 are disposed. Then, the recording sheet S, which has been switched back, passes through the curl correction member U4*a* and is ejected to the ejection tray TH1 in a state where the image fixed surface of the recording sheet S faces downward.

A circulation path SH6 is connected to the reverse path SH4 of the image forming unit U3, and a third gate GT3, which is an example of a switching member, is disposed in a portion at which the reverse path SH4 and the circulation path SH6 are connected to each other. A downstream end of the reverse path SH4 is connected to a reverse path SH7 of the media-processing device U4.

One of the recording sheets S that has been transported to the reverse path SH4 through the switching gate GT1 is transported to the side on which the reverse path SH7 of the media-processing device U4 is disposed by the third gate GT3. Similar to the second gate GT2, the third gate GT3 according to the first exemplary embodiment is formed of a thin-film-shaped elastic member. Accordingly, the third gate GT3 allows the recording sheet S, which has been transported along the reverse path SH4, to pass therethrough once. When the recording sheet S that has passed through the third gate GT3 is switched back, the third gate GT3 guides the recording sheet S to the side on which the circulation path SH6 is disposed.

The recording sheet S that has been transported to the circulation path SH6 is sent to the second transfer region Q4 again through the media transport path SH2, and a printing operation is performed on a second surface of the recording sheet S, the second surface being opposite to the image fixed surface of the recording sheet S.

The above-described components that are denoted by the reference signs SH1 to SH7 form a sheet transport path SH. The above-described components that are denoted by the reference signs SH, Ra, Rr, Rh, SGr, SG1, SG2, BH, and GT1 to GT3 form a sheet transport device SU according to the first exemplary embodiment.

(Description of Controller of First Exemplary Embodiment)

Figure 3:
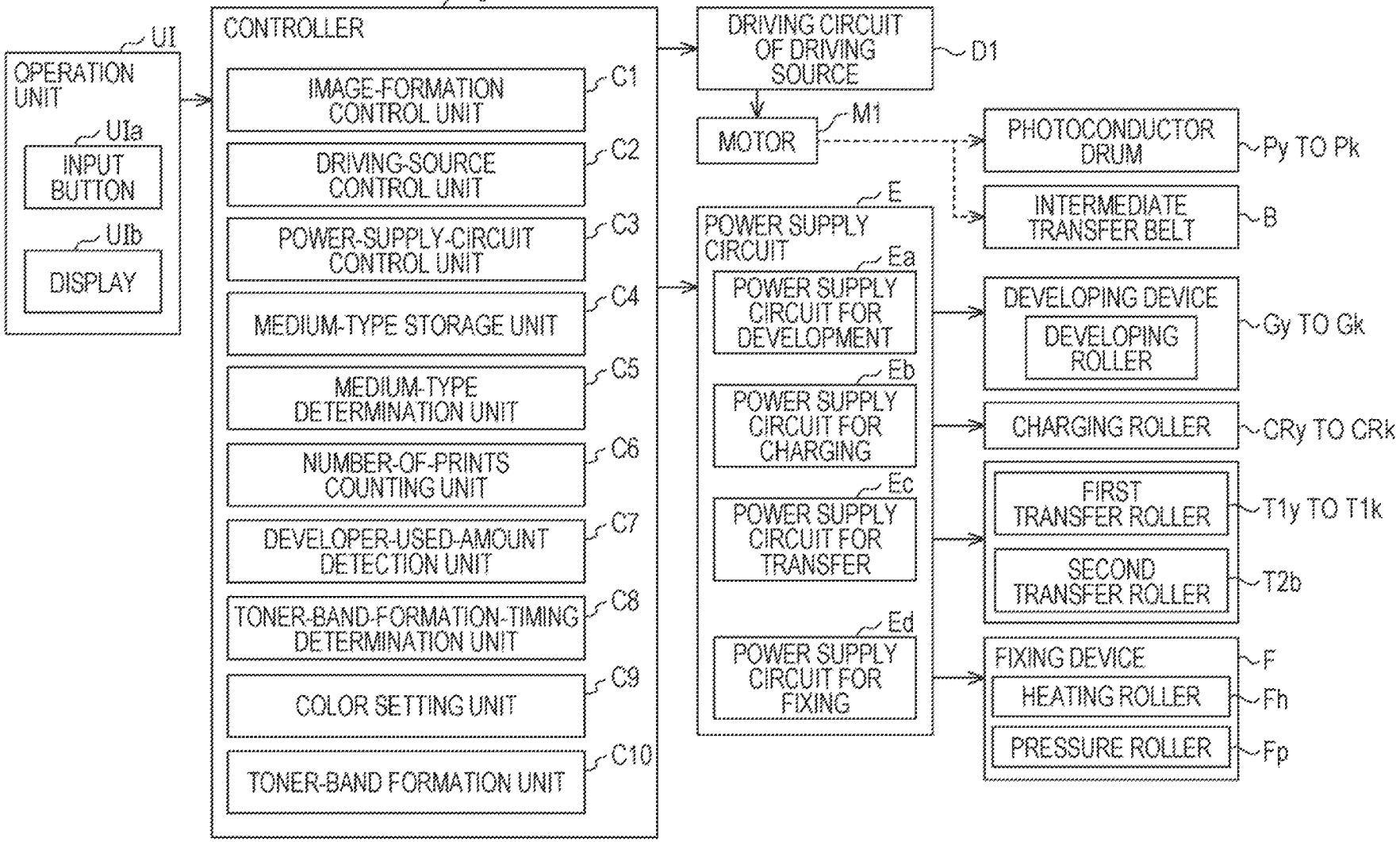
FIG. 3 is a block diagram illustrating functions of a controller of the image forming apparatus according to the first exemplary embodiment.

FIG. 3 is a block diagram illustrating functions of a controller of the image forming apparatus according to the first exemplary embodiment.

In FIG. 3, a controller C, which is an example of a control unit of the copying machine U, includes an input/output interface I/O that inputs and outputs signals to and from the outside. The controller C further includes read only memory (ROM) that stores programs and information for processing to be performed, information, and so forth. The controller C further includes random access memory (RAM) that temporarily stores necessary data. The controller C further includes a central processing unit (CPU) that performs processing according to the programs stored in the ROM and the like. Accordingly, the controller C of the first exemplary embodiment is formed of a small-sized information processing apparatus, or specifically, a microcomputer. Thus, the controller C may obtain various functions by executing the programs stored in the ROM and the like.

(Signal-Output Element Connected to Controller C)

An output signal from a signal-output element, such as the user interface UI, is input to the controller C.

The user interface UI includes, as examples of input units, the input buttons UIa including a copy start key, a numeric keypad, and an arrow that are used for performing input operations.

(To-Be-Controlled Element Connected to Controller C)

The controller C is connected to a driving circuit D1 of a driving source, a power-supply circuit E, and other control elements (not illustrated). The controller C outputs control signals to the circuits D1, E, and the like so as to control the circuits D1, E, and the like.

D1: Driving Circuit of Driving Source

The photoconductor drums Py to Pk, the intermediate transfer belt B, and so forth are driven so as to rotate by the driving circuit D1 of the driving source via a motor M1, which is an example of a driving source.

E: Power-Supply Circuit

The power-supply circuit E includes a power-supply circuit Ea for use in a developing operation, a power-supply circuit Eb for use in a charging operation, a power-supply circuit Ec for use in a transfer operation, and a power-supply circuit Ed for use in a fixing operation.

Ea: Power-Supply Circuit for Development

The power-supply circuit Ea for use in a developing operation applies a developing voltage to the developing rollers of the developing devices Gy to Gk.

Eb: Power-Supply Circuit for Charging

The power-supply circuit Eb for use in a charging operation applies a charging voltage for charging the surfaces of the photoconductor drums Py to Pk to the charging rollers CRy to CRk.

Ec: Power-Supply Circuit for Transfer

The power-supply circuit Ec for use in a transfer operation applies a transfer voltage to the first transfer rollers T1*y* to T1*k* and the backup roller T2*a*.

Ed: Power-Supply Circuit for Fixing

The power-supply circuit Ed for use in a fixing operation supplies power to a heater of the heating roller Fh of the fixing device F.

(Functions of Controller C)

The controller C has a function of outputting a control signal to each of the above-mentioned control elements by performing processing according to an input signal from the above-mentioned signal-output element. In other words, the controller C has the following functions.

C1: Image-Formation Control Unit

An image-formation control unit C1 controls, for example, driving of the members included in the scanner unit U1 and the image forming unit U3 or the timing of application of each voltage in accordance with an input to the user interface UI or an input of image information from an external personal computer or the like and executes a job, which is an image forming operation.

C2: Driving-Source Control Unit

A driving-source control unit C2 controls driving of the motor M1 via the driving circuit D1 of the driving source and controls driving of the photoconductor drums Py to Pk and so forth.

C3: Power-Supply-Circuit Control Unit

A power-supply-circuit control unit C3 controls the power-supply circuits Ea to Ed and controls the voltages to be applied to each member and the power to be supplied to member.

C4: Medium-Type Storage Unit

A medium-type storage unit C4 stores the types of the recording sheets S, each of which is an example of a medium to be used. The types of the recording sheets S, which are accommodated in the sheet-feeding trays TR1 to TR4 of the feeder unit U2, are stored in the sheet-type-information storage unit C4 according to the first exemplary embodiment in such a manner as to be distinguished in accordance with the sheet-feeding trays TR1 to TR4. Note that, in the first exemplary embodiment, the types of the recording sheets S, which are accommodated in the sheet-feeding trays TR1 to TR4, that are set and registered by input operations performed through the user interface UI are stored. The types of the recording sheets S may each be set to one selected from "thin paper", "normal paper", "thick paper", "embossed paper", "Japanese paper", "coated paper", and so forth, or the type of each of the recording sheets S may be set by, for example, directly inputting a "sheet basis weight".

C5: Medium-Type Determination Unit

A medium-type determination unit C5 determines the type of one of the recording sheets S that is used in a printing operation. The sheet-type-information determination unit C5 according to the first exemplary embodiment determines the type of the recording sheet S on the basis of information items regarding the types of the recording sheets S in the sheet-feeding trays TR1 to TR4, the information items being stored in the medium-type storage unit C4, and at least one of the sheet-feeding trays TR1 to TR4 that is used in the printing operation. In addition, the sheet-type-information determination unit C5 according to the first exemplary embodiment determines whether the recording sheet S is one of embossed paper and Japanese paper, each of which is an example of a medium having a high transfer sensitivity, or one of thin paper, normal paper, thick paper, and coated paper, each of which is an example of a medium having a low transfer sensitivity.

Note that, in the specification and the claims of the present application, the term "transfer sensitivity" refers to the non-transferability of an image to one of the recording sheets S and, on the other hand, refers to the transferability of an image to one of the recording sheets S. In the following description, a medium in which a transfer failure is likely to occur when there are fluctuations in the environments such as temperature and humidity when there are fluctuations in an applied voltage, or even when the speed at which a medium is transported is slightly changed will be referred to as "a medium having a high transfer sensitivity". Conversely, a medium in which a transfer failure is less likely to occur will be referred to as "a medium having a low transfer sensitivity". Therefore, thin paper, normal paper, thick paper, and coated paper each of which has a smooth surface and a substantially uniform density of fiber such as pulp have a low transfer sensitivity. In contrast, embossed paper that has projections and depressions formed on its surface and Japanese paper (a medium having a low density) that has an uneven density of pulp or the like and a large number of voids formed therein have a high transfer sensitivity. Although it will be described later with reference to FIG. 6, this is because, when a transfer voltage is applied to embossed paper or Japanese paper, the electrical resistance of a portion of the paper, the portion having a recess or a void, (a portion containing no fiber) and the electrical resistance of a portion of the paper, the portion containing fiber, are different from each other, or when electric discharge occurs in a recess or a void, the transfer voltage fluctuates, and a transfer failure is likely to occur.

Note that, in the following description, sheets such as embossed paper and Japanese paper will sometimes be inclusively referred to as "high sensitive sheets" each of which is an example of a first medium, and sheets such as normal paper will sometimes be inclusively referred to as "low sensitive sheets" each of which is an example of a second medium.

Note that, in the first exemplary embodiment, although the case has been described as an example in which the type of a medium is determined on the basis of the information items stored in the medium-type storage unit C4, the present disclosure is not limited to this case. For example, a sensor may be disposed in each of the sheet-feeding trays TR1 to TR4 of the feeder unit U2 or may be disposed on at least one of the transport paths SH1 and SH2 extending from the sheet-feeding trays TR1 to TR4 to the registration rollers Rr, the sensor being an example of a sensing member that detects the type of a medium on the basis of the thickness, the light transmittance, the light reflectance, the polarization property, the surface roughness, and so forth of the medium, and the type of one of the recording sheets S that is used in a printing operation may be detected and determined. Thus, for example, when the surface roughness of one of the recording sheets S that is detected by such a sensor is greater than a predetermined value (a threshold), that is, when projections and depressions formed on the surface of the recording sheet S are large, the recording sheet S may be determined to be a high sensitive sheet. In addition, the density (=weight/(thickness×area)) of the recording sheet S that is detected by the sensor is less than a predetermined value (a threshold), that is, when the recording sheet S has a large number of voids formed therein, the recording sheet S may be determined to be a high sensitive sheet.

C6: Number-of-Prints Counting Unit

A number-of-prints counting unit C6, which is an example of a number-of-transfers counting unit, counts the number of prints, which is an example of the number of transfers. In other words, the number-of-prints counting unit C6 counts the number of times a transfer operation for transferring a print image, which is an example of an image that is intended to be transferred, onto one of the recording sheets S has been performed. Note that, in the first exemplary embodiment, when a toner band (described later), which is an example of an image that is not intended to be transferred, is formed, the number of prints is initialized, or reset.

C7: Developer-Used-Amount Detection Unit

A developer-used-amount detection unit C7 detects the amount of a developer used in image formation. The developer-used-amount detection unit C7 according to the first exemplary embodiment calculates, on the basis of the number of pixels written by the latent-image forming devices ROSy to ROSk, the amounts of different color developers that are used and adds up the amounts so as to detect the total amount of the developer used. Note that the amounts of the developers used are not limited to being derived on the basis of the number of pixels written by the latent-image forming devices ROSy to ROSk and may be derived from, for example, the density of a read image or changes in the weights of the developing devices Gy to Gk, in which the developers are accommodated.

Figure 4:
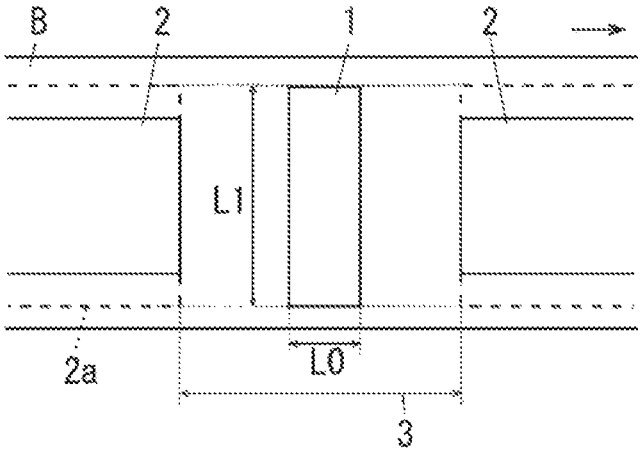
FIG. 4 is a diagram illustrating an example of a toner band according to the first exemplary embodiment.

FIG. 4 is a diagram illustrating an example of a toner band according to the first exemplary embodiment.

C8: Toner-Band-Formation-Timing Determination Unit

A toner-band-formation-timing determination unit C8 determines whether the timing at which toner bands 1, each of which is an example of an image that is not intended to be transferred, are to be formed has come. In the first exemplary embodiment, the following timings are each set as the timing at which the toner bands 1 are to be formed: when a job is started in the case where the type of sheets to be used is changed from a low sensitive sheet to a high sensitive sheet, each time an inter-image region 3 is formed during execution of a job using a high sensitive sheet, and when a printing operation has been continuously performed on a predetermined number of low sensitive sheets. In other words, in the case where low sensitive sheets have been used in the previous job, and the type of sheets to be used is changed to a high sensitive sheet from the current job, an operation in a recovery mode, which is an example of an operation for forming the toner bands 1, is performed before a series of image forming operations (a job) such as copying operations or printing operations to be performed on one or more sheets is started. In addition, during execution of a job using a high sensitive sheet, the toner bands 1 are set to be formed in the inter-image regions 3 that are non-image regions each located between print images 2, each of which is an example of an image that is intended to be transferred. Furthermore, when a printing operation has been continuously performed on 5,000 (an example of a predetermined number of sheets) low sensitive sheets, the toner bands 1 are to be formed in the inter-image regions 3.

Note that, in the first exemplary embodiment, although a case has been described as an example in which the toner bands 1 are formed in all the inter-image regions 3 when a high sensitive sheet is used, the present disclosure is not limited to this case. The toner band 1 may be formed once every two inter-image regions 3, or the toner band 1 may be formed once every three or more inter-image regions 3.

C9: Color Setting Unit

A color setting unit C9 sets the color of the toner bands 1 to be formed. The color setting unit C9 according to the first exemplary embodiment sets the color of the toner bands 1 that are to be formed during execution of a job using a high sensitive sheet, which is an example of the timing at which the toner bands 1 are to be formed, or when a printing operation is performed on a low sensitive sheet, which is another example of the timing at which the toner bands 1 are to be formed. In other words, the color setting unit C9 sets the color of the toner bands 1 each time the toner bands 1 are formed. The color setting unit C9 according to the first exemplary embodiment sets, on the basis of the amounts of the different color developers used that have been detected by the developer-used-amount detection unit C7, the color of one of the developers that has been used by the smallest amount as the color of the toner bands 1 to be formed. Note that, the present disclosure is not limited to this configuration, and two colors, which are the color of the developer that has been used by the smallest amount and the color of the developer that has been used by the second smallest amount among the developers of the four colors of Y, M, C, and K, may be set, or three colors may be set. Note that the color to be set is not limited to the color of the developer that has been used by a small amount, and any parameter related to deterioration of each developer may be used. For example, a parameter such as the case where one of the developers has been stirred as a result of a corresponding one of the developing devices Gy to Gk operating for a certain period of time or longer in a state where the amount of the developer used is equal to or lower than a predetermined threshold or the case where the amount of one of the developers supplied to a corresponding one of the developing devices Gy to Gk is small.

C10: Toner-Band Formation Unit

A toner-band formation unit C10 forms the toner bands 1, each of which is an example of an image for supplying a developer to a cleaning unit. In the recovery mode, which is an example of a first forming mode, the toner-band formation unit C10 according to the first exemplary embodiment forms, as the toner bands 1, each of which is an example of an image having a belt-like shape, images each of which has a total density of 40%, that is, images each of which includes images of colors Y, M, C, and K each having a density of 10%, in such a manner that the formed images correspond to 100 pages of A4 paper, or 10 pages of A4-size solid images, while the recording sheets S are not transported. Then, a voltage having a polarity opposite to the polarity of the second transfer voltage is applied in the second transfer region Q4, and the developers forming the toner bands 1 are supplied to the belt cleaner CLB.

In addition, the toner-band formation unit C10 according to the first exemplary embodiment performs an operation in a high-sensitive-sheet mode, which is another example of the first forming mode, during execution of a job using a high sensitive sheet and forms the toner band 1 in each of the inter-image regions 3 by using the developer of the color, which has been set by the color setting unit C9. Furthermore, when a printing operation is performed on a low sensitive sheet, the toner-band formation unit C10 performs an operation in a low-sensitive-sheet mode, which is an example of a second forming mode, and forms the toner bands 1 in the inter-image regions 3 by using the developer of the color set by the color setting unit C9 each time the printing operation is performed on 5,000 low sensitive sheets.

Note that the toner bands 1 that are formed each time the printing operation is performed on 5,000 low sensitive sheets are set to have a density lower than the density of the toner bands 1 that are formed when a printing operation is performed on a high sensitive sheet. In other words, the amount of the developer to be used is reduced. As an example, the density of each of the toner bands 1 in the case of a high sensitive sheet may be set to 0.75%, and the density of each of the toner bands 1 in the case of a low sensitive sheet may be set to 0.25%. Note that the density of each of the toner bands 1 in the case of a high sensitive sheet is preferably set to 0.5% or higher and is more preferably set to 0.75% or higher. Although the case has been described as an example in which the density of each of the toner bands 1 in the case of a low sensitive sheet is set to 0.25%, the present disclosure is not limited to this case, and the density of each of the toner bands 1 in the case of a low sensitive sheet may be set to 0%, that is, no toner band 1 may be formed in the case of a low sensitive sheet. Note that, in the specification and the claims of the present application, the wording "the density of each of the toner bands 1 in the case of a low sensitive sheet" is used to include a case of a density of 0%.

Note that, even if the density of each of the toner bands 1 in the case of a low sensitive sheet and the density of each of the toner bands 1 in the case of a high sensitive sheet are the same as each other, the toner bands 1 are more frequently formed in the case of a high sensitive sheet than in the case of a low sensitive sheet, and the total amount of the developer used in the case of a high sensitive sheet is larger than that in the case of a low sensitive sheet.

In the first exemplary embodiment, the size of each of the toner bands 1, that is, a length L0 and a width L1 of each of the toner bands 1 in the direction in which the toner band 1 is transported along the intermediate transfer belt B, is set to a predetermined size. As an example, the width L1 is set to correspond to the maximum width (e.g., A3) of a print image 2*a* that is formable by the copying machine U. Thus, the width L1 is set to cover the entire minimum width (e.g., A5) of the print image 2*a*. Note that the width L1 may be set to be larger than the maximum width of the print image 2*a* and equal to or smaller than the width of the intermediate transfer belt B.

Note that the amounts of the developers that are used increase as the length L0 or the width L1 in the direction in which the toner bands 1 are transported along the intermediate transfer belt B becomes larger. Thus, in the first exemplary embodiment, although the density is increased in the case of a high sensitive sheet, the width L1 or the length L0 may be increased without increasing the density, or the length L0 and the like as well as the density may be increased.

(Description of Flowchart of First Exemplary Embodiment)

A control flow in the copying machine U according to the first exemplary embodiment will now be described with reference to a flowchart.

(Description of Flowchart of Toner-Band Forming Process)

Figure 5:
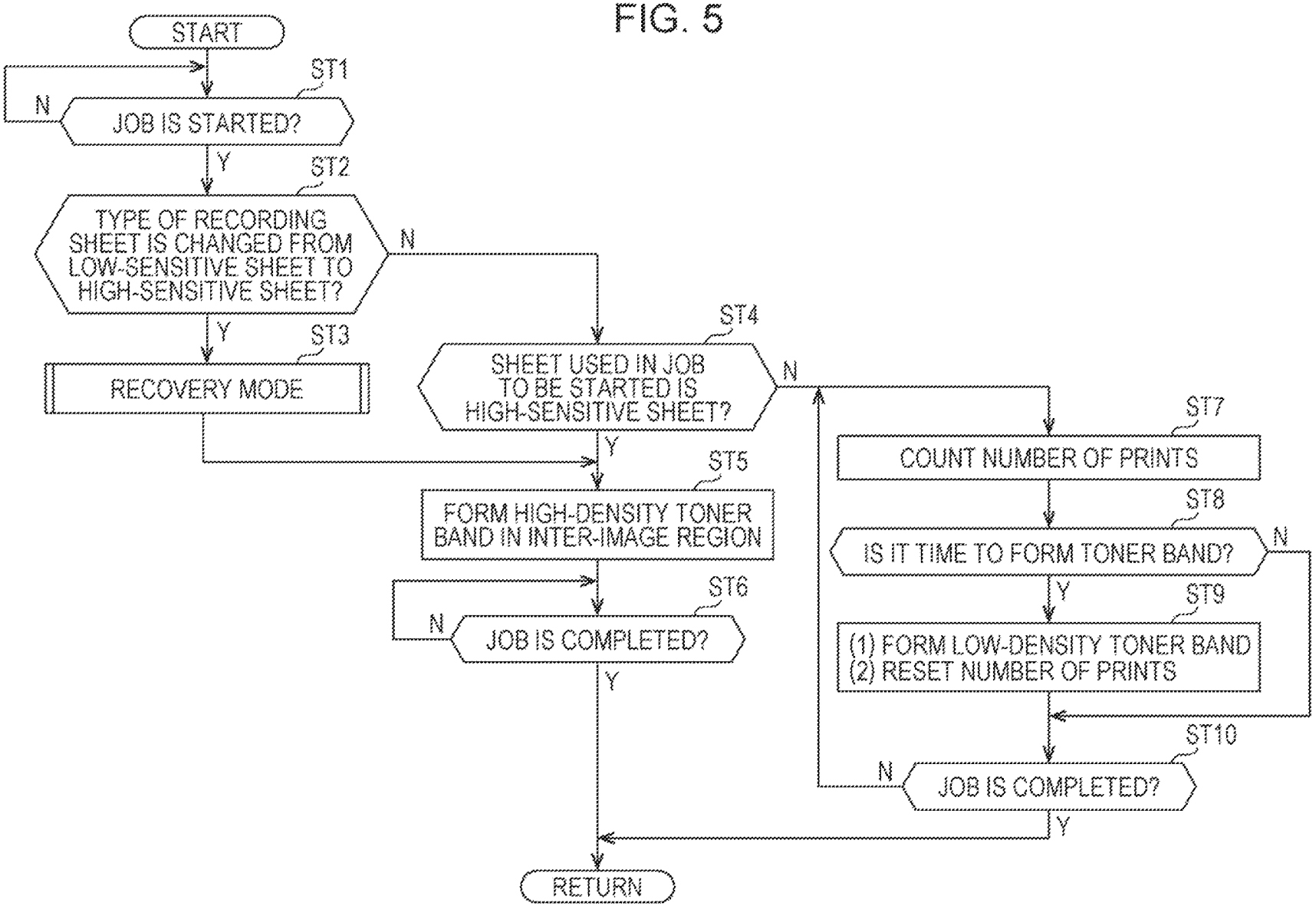
FIG. 5 is a flowchart of a toner-band forming process according to the first exemplary embodiment.

FIG. 5 is a flowchart of a toner-band forming process according to the first exemplary embodiment.

The operations in steps ST of the flowchart illustrated in FIG. 5 are each performed in accordance with a program stored in the controller C of the copying machine U. The process is executed in parallel with various other processes performed by the copying machine U. Thus, a process in which an image is formed on each of the recording sheets S upon start of a job is executed in parallel with the process illustrated in the flowchart in FIG. 5.

The process illustrated in the flowchart in FIG. 5 is started when the copying machine U is switched on.

In ST1 in FIG. 5, it is determined whether a job has been started. When the determination result in ST1 is Yes (Y), the process continues to ST2, and when the determination result in ST1 is No (N), ST1 is repeated.

In ST2, it is determined whether the type of the recording sheets S to be used has been changed from a low sensitive sheet to a high sensitive sheet. When the determination result in ST2 is Yes (Y), the process continues to ST3, and when the determination result in ST2 is No (N), the process proceeds to ST4.

In ST3, an operation in the recovery mode is performed before the print images 2 are formed. In other words, in the recovery mode, images each of which has a density of 40% are formed in such a manner that the formed images correspond to 100 pages of A4 paper. Then, the process continues to ST5.

In ST4, it is determined whether the type of the recording sheet S to be used in the started job is a high sensitive sheet. When the determination result in ST4 is Yes (Y), the process continues to ST5, and when the determination result in ST4 is No (N), the process proceeds to ST7.

In ST5, formation of the print images 2 is started, and the toner bands 1 each of which has a high density for a high sensitive sheet are formed in the inter-image regions 3. Then, the process continues to ST6.

In ST6, it is determined whether the job has been terminated. When the determination result in ST6 is Yes (Y), the process returns to ST1, and when the determination result in ST6 is No (N), ST6 is repeated.

In ST7, formation of the print images 2 is started, and counting of the number of prints is started. Then, the process continues to ST8.

In ST8, it is determined whether the timing at which the toner bands 1 are to be formed has come. In other words, it is determined whether the counted number of prints has reached 5,000, which is a threshold for determination. When the determination result in ST8 is Yes (Y), the process returns to ST9, and when the determination result in ST8 is No (N), the process proceeds to ST10.

In ST9, the following processing operations (1) and (2) are performed, and the process continues to ST10.

(1) The toner bands 1 each of which has a low density for a low sensitive sheet are formed.

(2) The number of prints is reset, or initialized.

In ST10, it is determined whether the job has been terminated. When the determination result in ST10 is Yes (Y), the process returns to ST1, and when the determination result in ST10 is No (N), the process returns to ST7.

(Effects of First Exemplary Embodiment)

In the copying machine U according to the first exemplary embodiment, which has the above-described configuration, as the image forming operation proceeds, the print images 2 are transferred, in the second transfer process, from the intermediate transfer belt B onto the recording sheets S. In this case, in the second transfer region Q4, electric discharge occurs locally, and discharge products are deposited onto the intermediate transfer belt B. Although the belt cleaner CLB removes the discharge products, some of the discharge products are not completely removed and remain on the intermediate transfer belt B, and the amount of the discharge products remaining on the intermediate transfer belt B increase over time. As a result, the adhesion strength between the intermediate transfer belt B and the developers of the print images 2 that have been transferred in the first transfer process to the intermediate transfer belt B increases. This increase in the adhesion strength makes it difficult for the developers to be transferred onto the recording sheets S when the print images 2 are transferred in the second transfer process. Consequently, a transfer failure is likely to occur, and an image quality defect is likely to occur.

In order to address such an increase in the amount of the discharge products remaining on the intermediate transfer belt B over time, formation of images, such as toner bands, that are not intended to be transferred has been performed in the related art. Each of the developers contains a lubricating material or the like as an additive, and the cleaning performance of the belt cleaner CLB is improved by supplying the developers to the belt cleaner CLB so as to remove the discharge products that have not been completely removed.

Figure 6A:
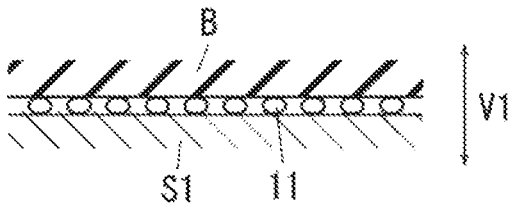
FIGS. 6A to 6C are diagrams each illustrating a voltage that acts in a transfer region, FIG. 6A, FIG. 6B, and FIG. 6C being respectively a diagram illustrating an example of a low sensitive sheet, a diagram illustrating an example of embossed paper, and a diagram illustrating an example of Japanese paper.
Figure 6B:
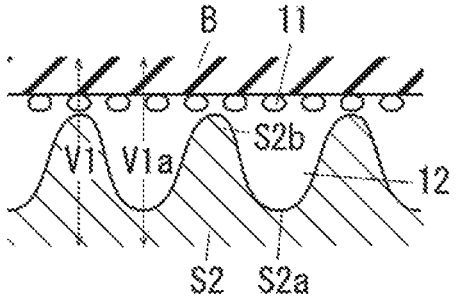
Figure 6C:
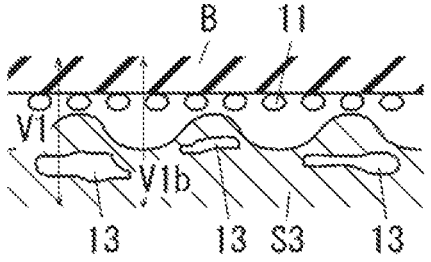

FIGS. 6A to 6C are diagrams each illustrating a voltage that acts in a transfer region. FIG. 6A is a diagram illustrating an example of a low sensitive sheet. FIG. 6B is a diagram illustrating an example of embossed paper. FIG. 6C is a diagram illustrating an example of Japanese paper.

In FIGS. 6A to 6C, a low sensitive sheet S1 such as normal paper has a smooth surface and has only few voids formed therein, and thus, the second transfer voltage approximately acts uniformly in the second transfer region Q4.

In contrast, as illustrated in FIG. 6B, embossed paper S2, which is an example of a high sensitive sheet, has projections and depressions formed on its surface, and gaps 12 is formed between depressions S2*a* and the intermediate transfer belt B. Thus, the electrical resistance varies between projections S2*b* having no gap 12 and the depressions S2*a* having the gaps 12 in a thickness direction. Consequently, electric discharge is likely to occur in the gaps 12, and there is a possibility that a second transfer voltage V1*a* that acts in the depressions S2*a* will change. Therefore, in the depressions S2*a*, a transfer failure is more likely to occur than in the low sensitive sheet S1.

In FIG. 6C, in Japanese paper S3, which is an example of a high sensitive sheet, voids (gaps) 13 are easily formed therein, and as in the case of the embossed paper S2, a transfer failure is more likely to occur in a portion that has the voids 13 than in a portion that does not have the voids 13. In other words, not only in Japanese paper, but also in one of the recording sheets S that has voids formed therein and that has a low-density, a transfer failure is likely to occur.

Thus, there is a problem in that, if the high sensitive sheets S2 and S3 are used in a situation in which a transfer failure is likely to occur due to an increase in the amount of the discharge products over time, a transfer failure will be more likely to occur. Accordingly, the high sensitive sheets S2 and S3 are more susceptible to the influence of discharge products (have a higher sensitivity) than the low sensitive sheet S1.

In contrast, in the first exemplary embodiment, in the case where the high sensitive sheets S2 and S3 are used, the amount of the developer used for forming the toner bands 1 is set to be larger than that in the case where the low sensitive sheet S1 is used. In other words, compared with the case of the low sensitive sheet S1, the performance of removing discharge products is improved, and the amount of discharge products remaining on the intermediate transfer belt B is smaller.

In particular, in the first exemplary embodiment, when the type of the recording sheets S to be used is changed from the low sensitive sheet S1 to the high sensitive sheet S2 or S3, the operation in the recovery mode for removing discharge products on the intermediate transfer belt B is performed. Thus, compared with the case where the operation in the recovery mode is not performed, the print images 2 are printed while the amount of the discharge products on the surface of the intermediate transfer belt B is small.

During execution of a job using the high sensitive sheet S2 or S3, the toner band 1 is formed in each of the inter-image regions 3. Thus, compared with the case where the toner bands 1 are not formed, the cleaning performance of the belt cleaner CLB is kept high, and the discharge products on the surface of the intermediate transfer belt B are likely to be continuously removed during execution of the job. In other words, the amount of the discharge products on the surface of the intermediate transfer belt B is kept small.

In addition, in the case of the low sensitive sheet S1 in which a transfer failure is less likely to occur, the toner bands 1 each having a low density are formed at regular intervals (every 5,000 sheets). Thus, discharge products are removed at regular intervals.

In the first exemplary embodiment, in the high-sensitive-sheet mode and in the low-sensitive-sheet mode, the developer to be used is set to the developer that has been used by the smallest amount among the developers of the four colors. In the developer that has been used by only a small amount, the percentage of a portion that has deteriorated as a result of being stirred in a corresponding one of the developing devices Gy to Gk with respect to the entire developer is large. Thus, by forcibly using the deteriorated developer in formation of the toner bands 1, replacement of the deteriorated developer with the new developer is facilitated.

EXPERIMENTAL EXAMPLES

Figure 7A:
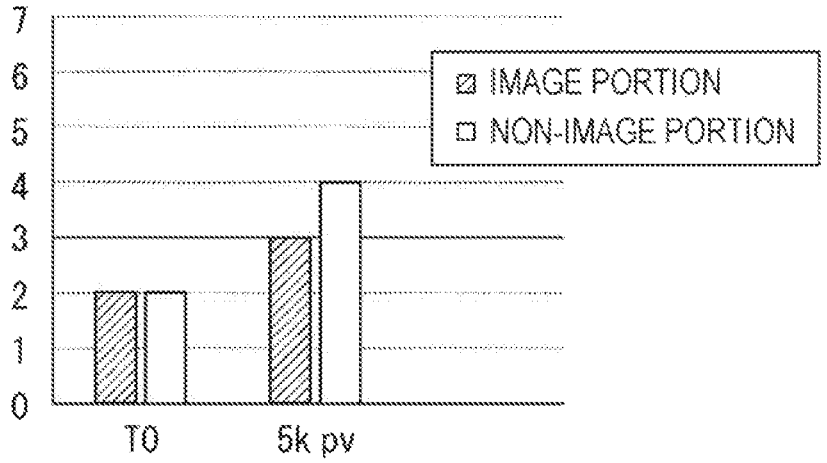
FIGS. 7A and 7B are diagrams illustrating a first experimental example of image quality (emboss grade) when embossed paper is used, FIG. 7A and FIG. 7B being respectively a graph having a horizontal axis denoting the number of prints and a vertical axis denoting emboss grade and a graph having a horizontal axis denoting adhesive force and a vertical axis denoting emboss grade.
Figure 7B:
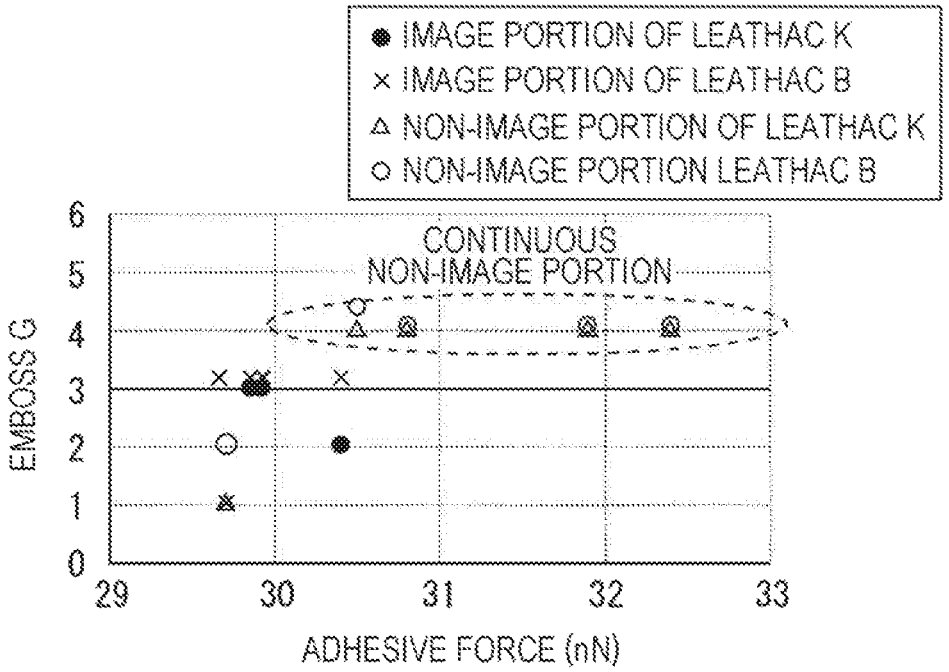

FIGS. 7A and 7B are diagrams illustrating a first experimental example of image quality (emboss grade) when embossed paper is used. FIG. 7A is a graph having a horizontal axis denoting the number of prints and a vertical axis denoting emboss grade. FIG. 7B is a graph having a horizontal axis denoting adhesive force and a vertical axis denoting emboss grade.

Next, an experiment for confirming the effects of the present disclosure is performed.

First Experimental Example

In the first experimental example, an experiment is conducted on how image quality (emboss grade) changes when a printing operation is continuously performed on embossed paper without forming a toner band. In the experiment, Leathac 66 manufactured by Tokushu Tokai Paper Co., Ltd) is used as embossed paper. Note that, in FIG. 7B, black Leathac 66 is referred to as "Leathac K", and blue Leathac 66 is referred to as "Leathac B". In addition, a Versant 3100 Press manufactured by Fuji Xerox Co., Ltd. is used as an image forming apparatus. In the experiment, a black full-page solid image (having a density of 100%), a black halftone image having a density of 60%, a blue full-page solid image (having a density of 100%), and a blue halftone image having a density of 60% are formed in a state in which the image forming apparatus is unused and in a state in which the image forming apparatus has printed an image having image portions 21 and non-image portions 22 (see FIG. 8, which will be described later) on 5,000 sheets (5 k PV), and the emboss grade and the adhesive forces of the developers with respect to the intermediate transfer belt B are measured.

In the above adhesive-force measurement, the intermediate transfer belt B is stopped in a state where the developers are deposited on the intermediate transfer belt B, and air is blown onto the developers. The average adhesive force (nN) per developer is calculated by using the air pressure at which the developers that are blown off by the air are visually observed.

Regarding the emboss grade, the roughness of each of the images is visually observed. Note that an acceptable range of the emboss grade is 3 or lower.

Figure 8:
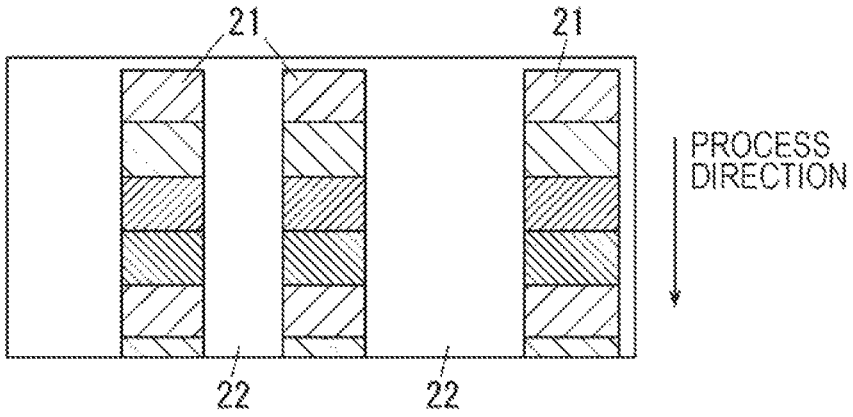
FIG. 8 is a diagram illustrating an image that is formed in the first experimental example.

FIG. 8 is a diagram illustrating an image that is formed in the first experimental example.

In the first experimental example, as the image, the three image portions 21 arranged at a pitch and the non-image portions 22 each of which is positioned between each two of the image portions 21 are formed as illustrated in FIG. 8. In other words, in the width direction of the intermediate transfer belt B, the developers are supplied to the belt cleaner CLB in regions that correspond to the image portions 21, and the developers are not supplied to the belt cleaner CLB in regions that correspond to the non-image portions 22.

In FIG. 7A, it is confirmed that, in the state in which the toner bands are not formed, the emboss grade decreases over time in the regions corresponding to the non-image portions 22. In other words, it is confirmed that a printing operation with a grade that is within the acceptable range may be performed on emboss paper in a portion such as each of the image portions 21 where the developers are continuously supplied and that the image quality degrades in a portion such as each of the non-image portions 22 where the developers are not supplied.

Although there are variations, it is confirmed in FIG. 7B that, when continuous printing is performed in the non-image portions 22, the adhesive force of each of the developers with respect to the intermediate transfer belt B is likely to increase, and the emboss grade is likely to decrease. It is also confirmed that, at least when the adhesive force is lower than 30 (nN), the emboss grade stays within the acceptable range.

Second Experimental Example

Figure 9A:
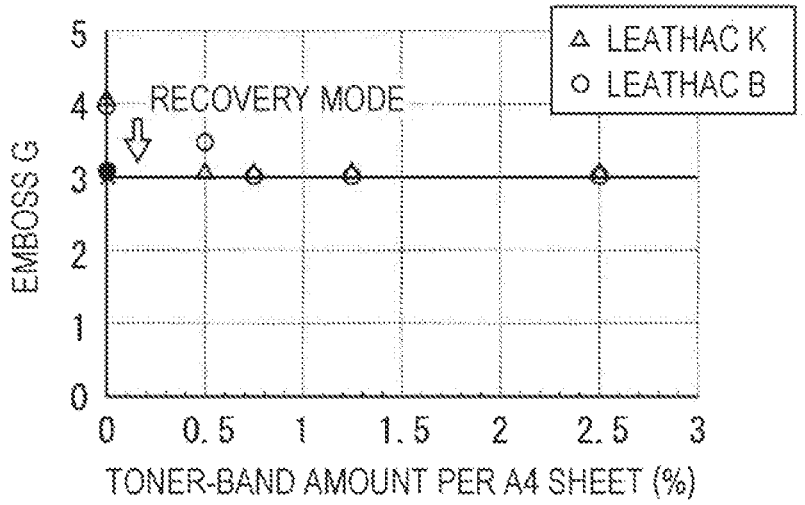
FIGS. 9A and 9B are diagrams illustrating experimental results of a second experimental example, FIG. 9A and FIG. 9B being respectively a graph having a horizontal axis denoting the density of a toner band and a vertical axis denoting emboss grade and a graph having a horizontal axis denoting the density of a toner band and a vertical axis denoting adhesive force.
Figure 9B:
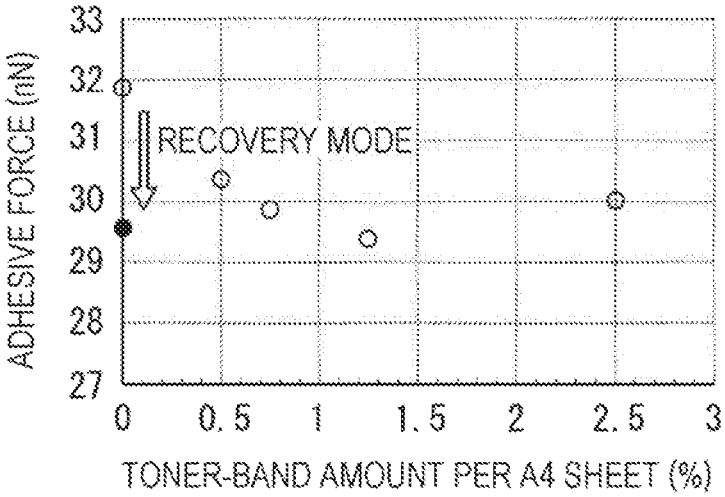

FIGS. 9A and 9B are diagrams illustrating experimental results of a second experimental example. FIG. 9A is a graph having a horizontal axis denoting the density of a toner band and a vertical axis denoting emboss grade. FIG. 9B is a graph having a horizontal axis denoting the density of a toner band and a vertical axis denoting adhesive force.

In the second experimental example, the relationship between the density of the toner band 1 and the emboss grade and the relationship between the density of the toner band 1 and the adhesive force are observed. In the second experimental example, an experiment is conducted under experimental conditions similar to those in the first experimental example.

In FIGS. 9A and 9B, when the density of the toner bands 1 is 0%, that is, when a printing operation is performed on 5,000 sheets without forming the toner bands 1, as illustrated in the upper part of "0%" in the graphs in FIGS. 9A and 9B, the emboss grade is as poor as "4", and the adhesive force is 32 (nN). Note that, when the operation in the recovery mode is performed in this state, as illustrated in the lower part of "0%" in the graphs in FIGS. 9A and 9B, the emboss grade recovers to "3", and the adhesive force also recovers to about 29.7 (nN).

In addition, when a printing operation is performed on 5,000 sheets while the density of the toner bands 1 is "0.5%", the emboss grade and the adhesive force are further improved than those in the case where the density of the toner bands 1 is "0%", and it is confirmed that, when the density of the toner bands 1 is "0.75%" or higher, the emboss grade stabilizes at "3" or lower, and the adhesive force also stabilizes at 30 (nN) or lower. Therefore, it is confirmed that, in the case of embossed paper, the density of the toner bands 1 is preferably 0.5% or higher and is more preferably 0.75% or higher.

FIG. 10 is a table illustrating emboss grades in an image portion and a non-image portion when the type of a sheet and the density of a toner band are changed.

As illustrated in FIG. 10, an experiment is performed by using J paper manufactured by Fuji Xerox Co., Ltd. (normal paper), OSC paper (coated paper), Rendezvous (rough paper), which is Korean paper, Leathac manufactured by Tokushu Tokai Paper Co., Ltd. (embossed paper), and Boss Yuki (embossed paper). J paper and OSC paper are examples of a low sensitive sheet, and Rendezvous, Leathac, and Boss Yuki are examples of a high sensitive sheet. Note that "Leathac" paper is similar to that used in the first experimental example.

As seen from the results illustrated in FIG. 10, in the case of the low sensitive sheets, no transfer failure is observed in the image portions 21 or the non-image portions 22. In other words, it is confirmed that there is no big problem with the toner bands 1 having a low density (0%). In contrast, in the case of the high sensitive sheets, it is confirmed that the image quality degrades in the non-image portions 22 when the toner bands 1 have a low density and that the deterioration of the image quality is improved as the density of the toner bands 1 becomes higher.

Note that, in the experimental example illustrated in FIG. 10, an experiment is also conducted to determine whether the results obtained by using the black toner bands 1 and the results obtained by using the blue toner bands 1 are different from each other, and no difference in the emboss grade is observed by changing the color of the developer.

Modifications

Although the exemplary embodiment of the present disclosure has been described in detail above, the present disclosure is not limited to the above-described exemplary embodiment, and various changes may be made within the scope of the present disclosure as described in the claims. Modifications (H01 to H08) of the present disclosure will be described below as examples.

(H01) In the above-described exemplary embodiment, although the copying machine U has been described as an example of an image forming apparatus, the image forming apparatus is not limited to the copying machine U, and the present disclosure may be applied to, for example, a facsimile machine or a multifunction machine that has a plurality of functions of a facsimile machine, a printer, a copying machine, and so forth. In addition, the image forming apparatus is not limited to being an image forming apparatus for multicolor development and may be an image forming apparatus that forms monochromatic images, or specifically, black-and-white images.

(H02) The specific values that have been mentioned as examples in the above-described exemplary embodiment may be suitably changed in accordance with design or specification.

(H03) In the above-described exemplary embodiment, in the case of a high sensitive sheet, the toner band 1 is formed in each inter-image region 3, that is, the toner band 1 is formed for each print image 2, and in the case of a low sensitive sheet, the toner bands 1 are formed for every 5,000 sheets. However, the present disclosure is not limited to this configuration. Although it is desirable that the frequency of formation of the toner bands 1 in the case of a high sensitive sheet be high while the frequency of formation of the toner bands 1 in the case of a low sensitive sheet is low, if the amount of toner used is acceptable, the frequency of forming the toner bands 1 in the case of a low sensitive sheet may be the same as that in the case of a high sensitive sheet. In this case, however, the density of the toner bands 1 in the case of a high sensitive sheet needs to be higher than that in the case of a low sensitive sheet.

In addition, although the case in which the toner bands 1 are formed for each sheet or for every 5,000 sheets has been described as an example, the frequency of formation of the toner bands 1 is not limited to this case and may be variable. For example, as the intermediate transfer belt B deteriorates over time, the number of times the intermediate transfer belt B is used (the accumulated number of prints from the unused state of the intermediate transfer belt B) increases, and in response to the deterioration of the intermediate transfer belt B over time, the frequency of formation of the toner bands 1 may be changed from every 5,000 sheets to every 4,000 sheets.

(H04) In the above-described exemplary embodiment, although it is desirable that the operation in the recovery mode be performed, a configuration in which the operation in the recovery mode is not performed may be employed. In the case of a low sensitive sheet, although the toner bands 1 are to be formed once for every 5,000 sheets, for example, the operation in the recovery mode may be performed once for every 5,000 sheets.

In the recovery mode, for example, before the type of sheets to be used is switched from a low sensitive sheet to a high sensitive sheet, the density and the area (corresponding to 100 pages of A4 paper) of each of the toner bands 1 that are formed in the recovery mode may be adjusted in accordance with the length of time over which the low sensitive sheets have been used continuously. In other words, the toner bands 1 are formed with a low frequency during the period when low sensitive sheets are used, and if low sensitive sheets are used for a long period of time, there is a possibility that numerous discharge products will accumulate on the intermediate transfer belt B. Thus, the density or the area of each of the toner bands 1 may be increased as the number of low sensitive sheets printed before the type of sheets to be used is switched from a low sensitive sheet to a high sensitive sheet increases, and the density or the area of each of the toner bands 1 may be decreased as the number of printed low sensitive sheets decreases.

(H05) In the above-described exemplary embodiment, although the case in which the color of the toner bands 1 is set to the color of the developer that has been used by a small amount has been described as an example, the present disclosure is not limited to this case. The color of the toner bands 1 may be fixed to a specific color, or a developer dedicated to the toner bands 1 that is different from the developers of the four colors may be provided. Alternatively, the toner bands 1 may be formed by using developers of specific two or three colors or may always be formed by using all the four colors.

(H06) In the above-described exemplary embodiment, although it is desirable that the operation in the recovery mode be performed before a job is started, a configuration in which the operation in the recovery mode is performed each time a job is terminated may be employed. In addition, in the case where a printing operation is continuously performed on high sensitive sheets, the printing operation may be temporarily stopped each time the printing operation is performed on a predetermined number of sheets (e.g., 500 sheets), and the operation in the recovery mode may be performed.

(H07) In the above-described exemplary embodiment, although the toner band 1 having a belt-like shape has been described as an example of an image that is not intended to be transferred, the image that is not intended to be transferred is not limited to this. The shape and the size of the image that is not intended to be transferred and the numbers of the images that are not intended to be transferred may be changed in accordance with design, specification, or the like. In other words, the image that is not intended to be transferred may not have a belt-like shape and may be a polygonal figure, a circular figure, a character, or the like, and the size of the image and the number of the images may also be changed. In addition, the amount of the developer that is used may be increased by increasing the size instead of changing the density, so that the amount of the developer that is supplied to the belt cleaner CLB may be increased.

(H08) In the above-described exemplary embodiment, although a case has been described an example in which the amount of the developer that is used is increased in order to suppress the occurrence of a transfer failure in the case of a high sensitive sheet, for example, a transfer failure may be suppressed by reducing the adhesive force of the developer with respect to the image holding unit or by improving the performance of removing discharge products in such a manner as to improve the transferability of the developer. In other words, a configuration may be employed in which, when a printing operation is performed by using a high sensitive sheet, an operation in a mode in which the adhesive forces of the developers become smaller than those in the case of a low sensitive sheet is performed. Note that the operation in this mode may be performed instead of or in addition to the operation in each of the forming modes of the exemplary embodiment. More specifically, as an example of improving the performance of removing discharge products from the image holding unit, at least one of the area of each of the toner bands 1, the density of each of the toner bands 1, and the frequency of formation of the toner bands 1 may be increased. As another example, it may be considered to increase the rotational speed of a rotary brush included in the belt cleaner CLB (cleaning unit) or to increase the contact pressure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image holding belt configured to hold a first image, wherein the first image is intended to be transferred onto a medium, wherein the image holding belt is configured to hold a second image, and wherein the second image is not intended to be transferred onto a medium;

a transfer roller configured to transfer the first image onto a medium;

a cleaner configured to remove the second image from the image holding belt; and a controller configured to control forming of the second image onto the image holding belt by using a developer, wherein the controller is configured to control a first forming mode for a first medium and to control a second forming mode for a second medium that has a transfer sensitivity lower than a transfer sensitivity of the first medium, and wherein the controller is configured to use a larger amount of the developer in formation of the second image in the first forming mode than in the second forming mode.

2. The image forming apparatus according to claim 1, wherein the first medium has a surface roughness greater than a surface roughness of the second medium.

3. The image forming apparatus according to claim 1, wherein the first medium is a medium having a medium density lower than a medium density of the second medium.

4. The image forming apparatus according to claim 2, wherein the first medium is a medium having a medium density lower than a medium density of the second medium.

5. The image forming apparatus according to claim 1, wherein the controller is configured to determine a type of the medium.

6. The image forming apparatus according to claim 2, wherein the controller is configured to determine a type of the medium.

7. The image forming apparatus according to claim 3, wherein the controller is configured to determine a type of the medium.

8. The image forming apparatus according to claim 4, wherein the controller is configured to determine a type of the medium.

9. The image forming apparatus according to claim 5, wherein the controller is configured to determine a medium that has a surface roughness greater than a predetermined value to be the first medium.

10. The image forming apparatus according to claim 6, wherein the controller is configured to determine a medium that has a surface roughness greater than a predetermined value to be the first medium.

11. The image forming apparatus according to claim 7, wherein the controller is configured to determine a medium that has a surface roughness greater than a predetermined value to be the first medium.

12. The image forming apparatus according to claim 8, wherein the controller is configured to determine a medium that has a surface roughness greater than a predetermined value to be the first medium.

13. The image forming apparatus according to claim 5, wherein the controller is configured to determine a medium that has a medium density lower than a predetermined value to be the first medium.

14. The image forming apparatus according to claim 6, wherein the controller is configured to determine a medium that has a medium density lower than a predetermined value to be the first medium.

15. The image forming apparatus according to claim 7, wherein the controller is configured to determine a medium that has a medium density lower than a predetermined value to be the first medium.

16. The image forming apparatus according to claim 8, wherein the controller is configured to determine a medium that has a medium density lower than a predetermined value to be the first medium.

17. The image forming apparatus according to claim 1, wherein the controller is configured to forming of the second image more frequently in the first mode than in the second mode.

18. The image forming apparatus according to claim 1, wherein when the second medium is used, a density of the second image is set to zero.

19. The image forming apparatus according to claim 1, wherein the controller is configured to control forming of an image by using developers of a plurality of colors, and each time the second image is formed, the controller sets a color of a developer forming the second image.

20. The image forming apparatus according to claim 19, wherein the controller controls forming of the second image by using a developer that has been used by the smallest amount among developers of a plurality of colors.

* * * * *